US010799735B2

(12) United States Patent
Hren et al.

(10) Patent No.: US 10,799,735 B2
(45) Date of Patent: Oct. 13, 2020

(54) FIRE APPARATUS VEHICLE WITH TURRET SUPPORT ARRANGEMENT

(71) Applicant: Seagrave Fire Apparatus, LLC, Clintonville, WI (US)

(72) Inventors: Davor Hren, Rijeka (HR); Damir Pinezic, Zagreb (HR); Charles Ptaschinski, Shawano, WI (US)

(73) Assignee: Seagrave Fire Apparatus, LLC, Clintonville, WI (US)

( * ) Notice: Subject to any disclaimer, the term of this patent is extended or adjusted under 35 U.S.C. 154(b) by 85 days.

(21) Appl. No.: 16/269,996

(22) Filed: Feb. 7, 2019

(65) Prior Publication Data

US 2019/0247688 A1 Aug. 15, 2019

Related U.S. Application Data

(60) Provisional application No. 62/628,468, filed on Feb. 9, 2018.

(51) Int. Cl.
*A62C 31/00* (2006.01)
*A62C 27/00* (2006.01)

(52) U.S. Cl.
CPC ..... *A62C 31/005* (2013.01); *A62C 27/00* (2013.01)

(58) Field of Classification Search
CPC ..... A62C 31/005; A62C 27/00
USPC ..... 169/24, 25, 52
See application file for complete search history.

(56) References Cited

U.S. PATENT DOCUMENTS

| | | | | |
|---|---|---|---|---|
| 3,253,677 | A * | 5/1966 | Krynytzky | B66F 11/044 169/24 |
| 3,367,280 | A * | 2/1968 | Bennett | F16L 1/00 169/25 |
| 4,410,045 | A | 10/1983 | Whitman | |
| 5,211,245 | A | 5/1993 | Relyea et al. | |
| 5,301,756 | A | 4/1994 | Relyea et al. | |
| 5,788,158 | A | 8/1998 | Relyea | |
| 6,808,025 | B2 | 10/2004 | Bissen et al. | |
| 2015/0273252 | A1 | 10/2015 | Lenz, Jr. et al. | |

FOREIGN PATENT DOCUMENTS

CN 105452150 3/2016

* cited by examiner

*Primary Examiner* — Steven J Ganey
(74) *Attorney, Agent, or Firm* — Boyle Fredrickson, S.C.

(57) ABSTRACT

A relatively small fire apparatus vehicle, which may have a single rear axle, is provided that includes a high-flow articulated water tower that delivers water at a rate of up to 1500 GPM (gallons per minute). The fire apparatus vehicle may include a turret support arrangement with a torque box that is supported from the vehicle chassis and that supports a turret at its turret base. A pair of outriggers is connected to at least two of the vehicle chassis, the torque box, and the turret base through a pair of outrigger mounts on opposite sides of the vehicle chassis.

15 Claims, 4 Drawing Sheets

FIRE APPARATUS VEHICLE WITH TURRET SUPPORT ARRANGEMENT

CROSS-REFERENCE TO RELATED APPLICATION

This application claims the benefit of U.S. Provisional Patent Application No. 62/628,468, filed on Feb. 9, 2018, the entirety of which is expressly incorporated by reference herein.

FIELD OF THE INVENTION

This invention relates generally to fire apparatus vehicles and, more particularly, to a turret support arrangement for a fire apparatus vehicle.

BACKGROUND OF THE INVENTION

Known articulated water tower fire apparatus vehicles are designed with compromises between vehicle size and water flow rating. Smaller sized fire apparatus vehicles can be beneficial in many situations. These situations include urban uses because the smaller vehicles are more maneuverable through narrow streets than larger ones. Articulated water towers with higher water flow ratings are beneficial for firefighting because they can deliver more water for extinguishing fires than those with lower water flow ratings.

However, implementing high-flow articulated water towers, such as those with flow rates of about 1500 GPM (gallons per minute), on small fire apparatus vehicles is challenging. Vehicles with high-flow articulated water towers can experience large reactionary forces, which can be strong enough to make small fire apparatus vehicles unstable. Accordingly, typical fire apparatus vehicles that support high-flow articulated water towers are large vehicles with tandem rear axles or larger chassis. Many of the large fire apparatus vehicles also have at least two pairs of outriggers to further stabilize the large vehicles against the reactionary forces of the high-flow articulated water towers.

SUMMARY OF THE INVENTION

The present invention is directed to a relatively small fire apparatus vehicle, such as a single rear axle vehicle with a GVWR (gross vehicle weight rating) of less than 50 k pounds, that has a high-flow articulated water tower that can deliver water at a rate of up to 1500 GPM and which may have a single outrigger for stabilizing the vehicle.

According to one aspect of the invention, a fire apparatus vehicle includes a turret support arrangement with an outrigger system that has a single pair of outriggers. A pair of outrigger mounts connects the outriggers to multiple structural components of the vehicle at different mounting locations. Each outrigger mount may connect a corresponding outrigger leg to a vehicle chassis frame rail, a torque rail of a torque box that supports a turret, and to a base of the turret.

According to another aspect of the invention, a turret support arrangement is provided for a fire apparatus vehicle. The fire apparatus vehicle has a vehicle chassis with a pair of chassis frame rails. The turret support arrangement includes a turret with an upper end configured to support an articulated water tower and a lower end that defines a turret base for supporting the turret and the articulated water tower. A torque box includes a pair of torque rails that are arranged parallel to and above the pair of chassis frame rails. An outrigger system includes a pair of outriggers. Each of the outriggers has a telescoping outrigger leg that extends outwardly and angularly downward with respect to the vehicle chassis. A pair of outrigger mounts supports the outriggers and each of the outrigger mounts has an outrigger mounting bracket. The outrigger mounting bracket extends across and interconnects at least two of the vehicle chassis, the torque box, and the turret base. This provides a mounting arrangement with multiple mounting interfaces at different heights to distribute loads across large surfaces areas and enhance vehicle stability during use of a high-flow water delivery system.

According to another aspect of the invention, each outrigger mounting bracket may extend across and interconnects each of the vehicle chassis, the torque box, and the turret base. Each outrigger mounting bracket may include a pair of mounting bracket side flanges that extend from opposite facing surfaces of an upper end of the respective telescoping outrigger leg. The mounting bracket side flanges may have triangular perimeter shapes and extend downwardly with respect to their attachment points to the outrigger leg and toward the torque box to provide a triangulated gusset attachment between the outrigger leg and the torque box.

According to another aspect of the invention, the turret base defines left and right turret sides that correspond to left and right sides of the vehicle chassis. At each of the left and right turret sides, the turret base may include a turret tie-in arrangement with a generally upright turret tie-in plate that faces outwardly away from the respective left or right turret side. The turret tie-in plate engages the outrigger mounting bracket plate to connect the respective telescoping outrigger leg to the turret base. A pair of upright turret tie-in plates may be arranged at each of the left and right sides of the turret, as outer components of upper outrigger mounts that are spaced from each other with a channel between, in which various components of the outrigger legs may be arranged such as an upper end of a movable leg segment.

According to another aspect of the invention, the torque box may define left and right torque box sides that correspond to left and right sides of the vehicle chassis. At each of the left and right torque box sides and at each of the left and right torque box sides, the torque box may include a torque box mount with a torque box mount plate. The torque box mount plate may be arranged generally upright and face outwardly away from the respective left or right torque box side. The torque box mount plate may engage the outrigger mounting bracket plate to connect the respective telescoping outrigger leg to the torque box. Respective turret tie-in plates and torque box mount plates may be general vertically aligned with each other, whereas an upper end of a hydraulic cylinder or other actuator that moves the outrigger leg's movable leg segment may be mounted more inwardly, such as attached to the turret.

According to another aspect of the invention, the fire apparatus vehicle has a single rear axle supported by the vehicle chassis and the torque box may include torque box mounts that extend from the torque rails and connect to the chassis frame rails with one of the torque box mounts arranged behind the rear axle and another arranged in front of the rear axle. The torque box may include least two torque box mounts arranged in front of the rear axle and one behind it, on each side of the torque box.

According to another aspect of the invention, the outrigger system includes an outrigger foot below each outrigger leg that defines inner and outer portions. An outrigger foot mount is arranged at the outrigger foot outer portion so a point of connection between the outrigger foot at the outrigger foot outer portion and a respective telescoping outrigger leg provides more of the outrigger foot inwardly beyond a lower edge of the telescoping outrigger leg than outwardly beyond the lower edge of the telescoping outrigger leg.

According to another aspect of the invention, a fire apparatus vehicle is provided that has a vehicle chassis with a pair of chassis frame rails. A turret is arranged above the vehicle chassis that includes an upper end configured to support an articulated water tower and a lower end that defines a turret base for supporting the turret and the articulated water tower. A turret support arrangement includes a torque box arranged above the pair of chassis frame rails and below the turret. The torque box is configured to transfer forces from the turret to the vehicle chassis. An outrigger system includes a pair of outriggers. Each of the outriggers includes a telescoping outrigger leg that extends outwardly and angularly downward with respect to the vehicle chassis. An outrigger support system includes pair of outrigger mounts connected to the pair of outriggers. Each of the outrigger mounts interconnects the vehicle chassis and the torque box. Each outrigger mount may include a mounting bracket plate with upper and lower portions. The respective telescoping outrigger leg is connected to the mounting bracket plate upper portion. The mounting bracket plate lower portion extends downwardly from the respective telescoping outrigger leg and is connected to the torque box. The outrigger support system includes torque box mount plates that extend downwardly from the torque box. Lower portions of the torque box mount plates are sandwiched between the lower portions of the outrigger mount's mounting bracket plate and the chassis frame rails.

Figure 1:
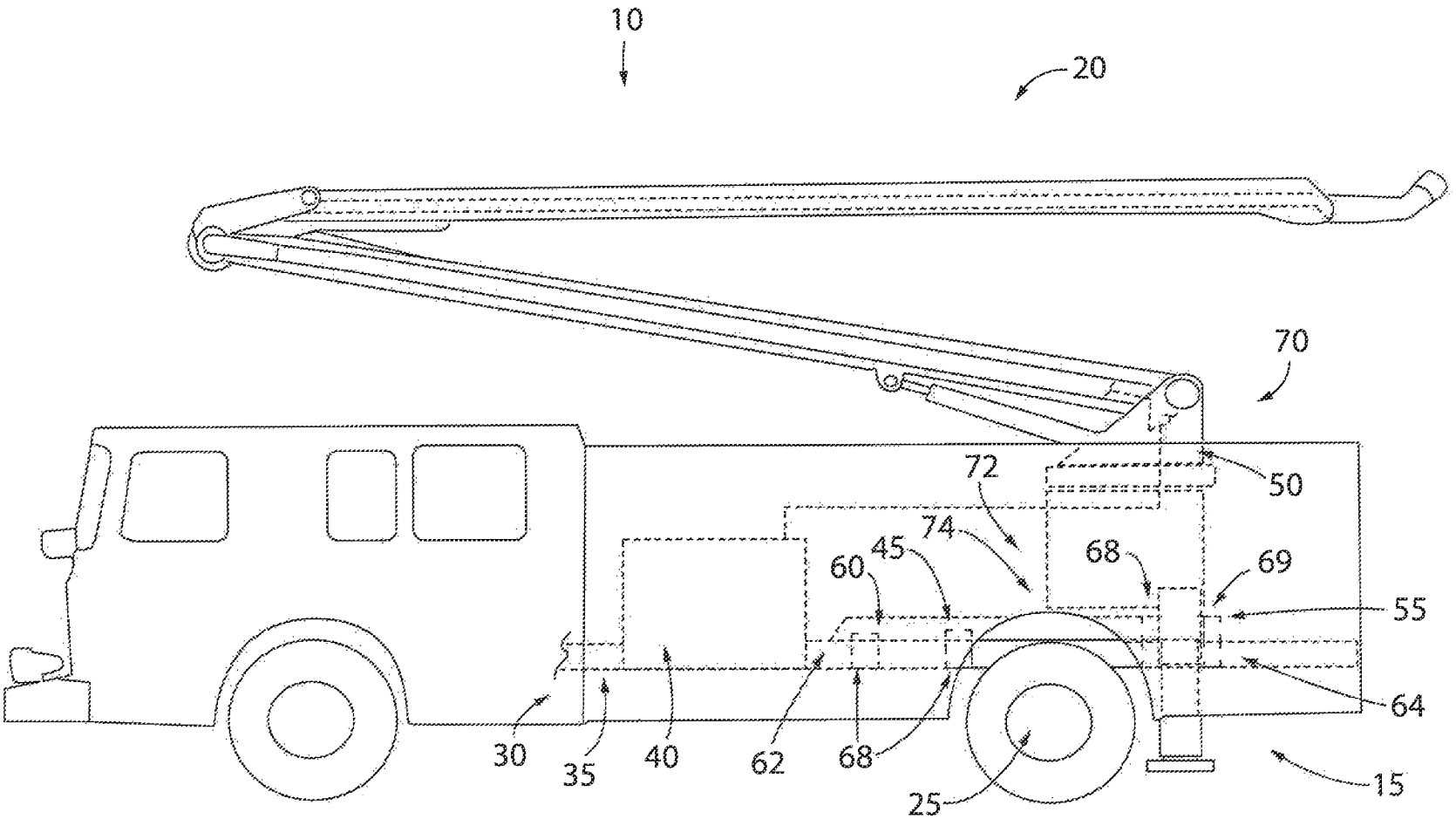
FIG. 1 is a side elevation of a fire apparatus vehicle with a turret support arrangement of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a fire apparatus vehicle, represented as vehicle 10, implements a turret support arrangement 15 and a high-flow articulated water tower, shown as articulated water tower 20, that provide substantial vehicle stability while delivering a large volume of water, with a flow rate up to about 1500 GPM (gallons per minute) through the articulated water tower 20. Vehicle 10 is shown as a relatively small fire apparatus vehicle, which may have a GVWR (gross vehicle weight rating) of less than 50 k pounds. Vehicle 10 is shown here with a single rear axle 25 that is supported by a vehicle chassis 30 that has a pair of chassis frame rails 35 (only one shown). Chassis frame rails 35 also support the turret support arrangement 15, articulated water tower 20, a front axle, a cab, and other bodywork, components, and systems of vehicle 10, including pump system 40 that is configured to pump water to the high-flow articulated water tower 20 to be delivered from the vehicle 10.

Still referring to FIG. 1, turret support arrangement 15 includes torque box 45 that supports a tower-supporting turntable or turret 50 and can rotate about a vertical axis and supports the articulated water tower 20, and the turret support arrangement 15 also includes an outrigger system 55 that is configured to provide stability to the vehicle 10 and the articulated water tower 20 during use. Torque box 45 includes a pair of torque rails 60 (only one shown) arranged parallel to and above the pair of chassis frame rails 35. Torque rails 60 are shown here sitting on top of the chassis frame rails 35 and extending across rear axle 25, with a torque rail front end 62 in front of the rear axle 25 and torque rail back ends 64 behind the rear axle 25.

Figure 2:
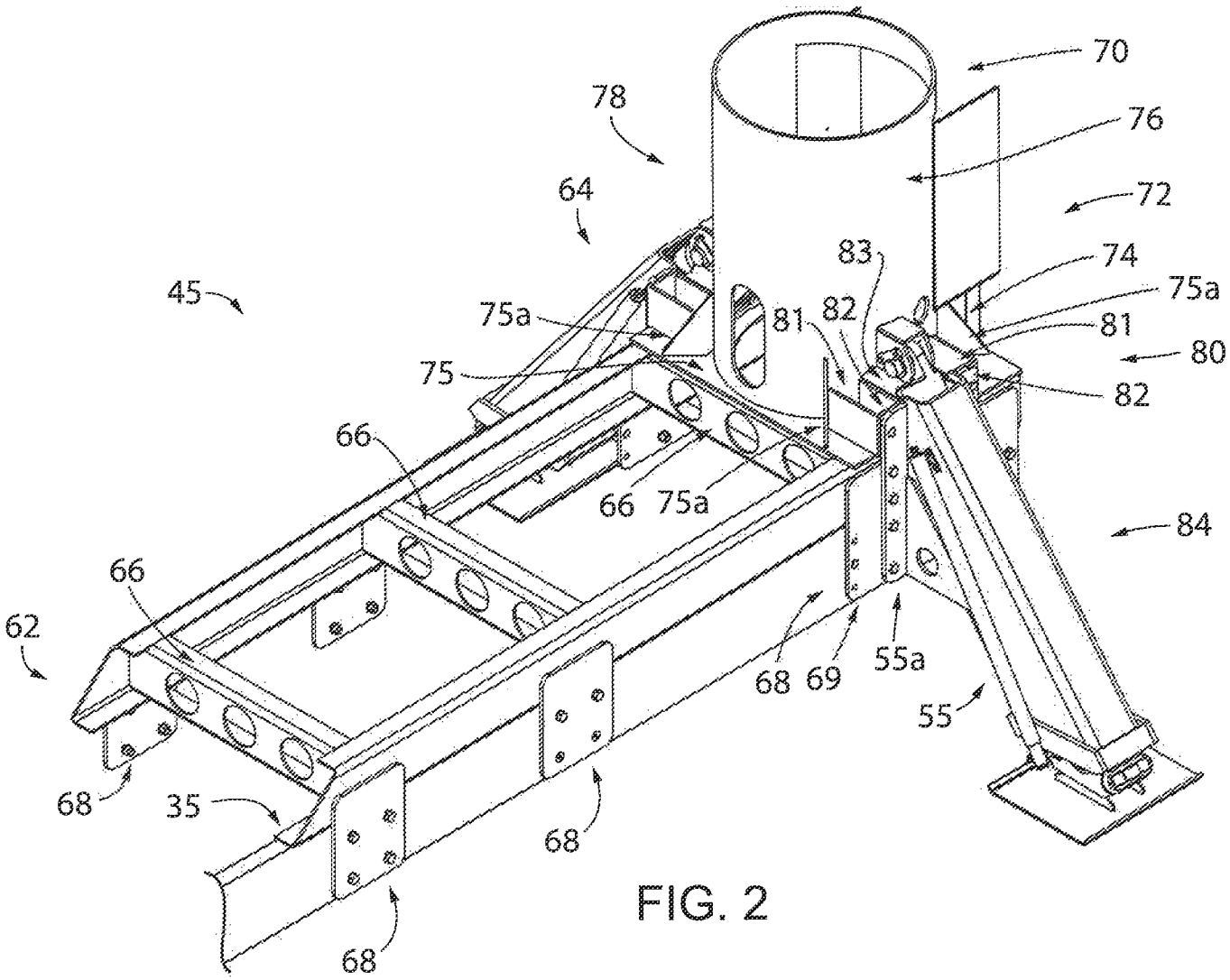
FIG. 2 is a pictorial view of portions of the turret support arrangement of FIG. 1.

Referring now to FIG. 2, torque box 45 includes cross-members 66 that extend perpendicularly between the torque rails 60 to define a ladder-like framework of interconnected components of torque box 45. Torque box mounts 68 are mounted at spaced-apart locations along the torque rails 60 and connect the torque rails 60 to the chassis frame rails 35. Referring again to FIG. 1, at each of the torque rails 60, at least one of the torque box mounts 68 is arranged behind the rear axle 25 and another is arranged in front of the rear axle 25. The torque box mounts 68 are shown here as vertically extending plates or torque box mount plates, with two torque box mounts 68 in front of rear axle 25 and a single torque box mount 68 behind the rear axle 25. Tying the torque box 45 both in front of and behind the rear axle 25 in this way allows the mass of vehicle 10 in front of rear axle 25 to act as ballast that resists or counteracts at least some forces that are applied behind the rear axle 25 through the turret 50.

Referring again to FIG. 2, turret 50 has an upper end 70 that provides a mounting structure for the articulated water tower 20 (FIG. 1) and a lower end 72 that defines a pedestal or turret base 74 that is connected to the torque box 45. Turret base 74 is shown here connected to the torque rail back ends 64, on turret support plate 75 that extends across and interconnects the torque rail back ends 64. Turret gussets **75*a* are generally triangular and extend between and connect the turret base 74 and the turret support plate 75. Turret base 74 has left and right turret sides 76, 78 that correspond to left and right sides of the vehicle chassis 30. At each of the left and right turret sides 76, 78, a first turret support gusset 75*a* is arranged toward the front of the turret base 74 and a second turret support gusset 75*a* is arranged toward the back of turret base 74. The turret base 74 has a turret tie-in arrangement 80 at each of the left and right turret sides 76, 78, between the respective pairs of turret support gussets 75*a*. Turret tie-in arrangement 80 is shown here with a pair of upper outrigger mounts 81, which are shown as box-like weldments with open tops and vertically arranged turret tie-in plates 82. Each turret tie-in plate 82 is connected by a pair of flanges or webs of material that collectively define the upper outrigger mount 81 and connect the turret tie-in plate 82 to the turret base 74 and the turret support plate 75. Each turret tie-in plate 82 is arranged generally upright and faces outwardly away from the respective left or right turret side 76, 78. The rear mounts of the torque box mounts 68 may define torque box/outrigger mounts 69 that are shown here as wider than the other torque box mounts 68. Torque box/outrigger mounts 69 are shown here as approximately the same width as the turret support plate 75 or the turret base 74. The torque box/outrigger mounts 69 and turret tie-in plates 82 of the upper outrigger mounts 81 provide structures for supporting outrigger system 55 and at least partially define an outrigger support system 55***a*. A space between the upper outrigger mounts 81 defines an upper portion of a channel 83.

Figure 3:
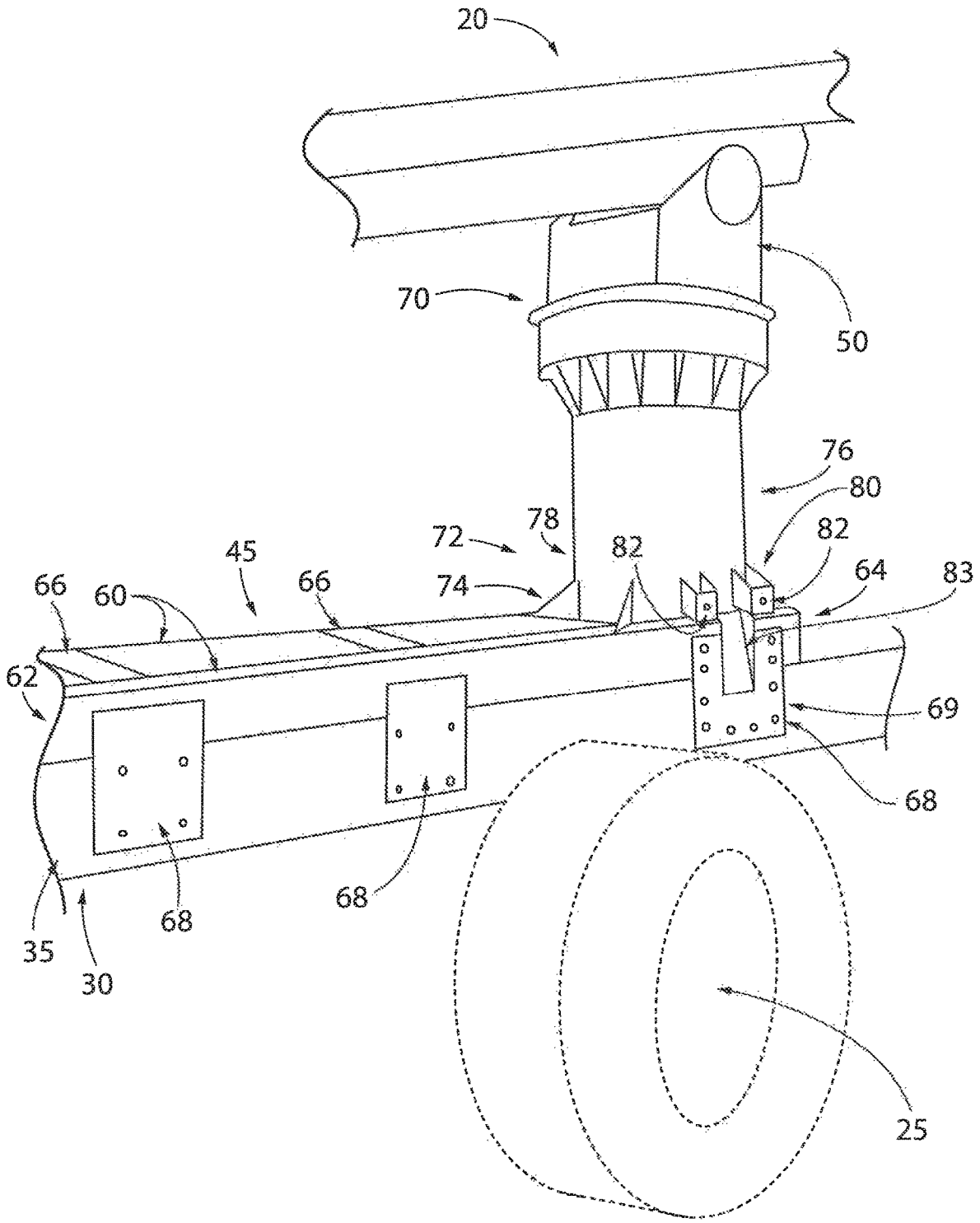
FIG. 3 is a simplified pictorial view of portions of the turret support arrangement of FIG. 1.

Referring now to FIG. 3, as shown in this simplified view, at least one of the torque box mounts 68 is arranged behind the rear axle 25, whereas at least one other one of the torque box mounts 68 is arranged in front of the rear axle 25. This provides a chassis tie-in arrangement that longitudinally straddles the rear axle 25. As shown here, the rear-most torque box mount 68 or torque box/outrigger mount(s) 69 connects the torque box 45 to the chassis frame rails 35 behind the rear axle 25. Channel 83 is shown here extending angularly back from the torque box mount 68, through the torque rail 60, toward the turret lower end 72.

Figure 4:
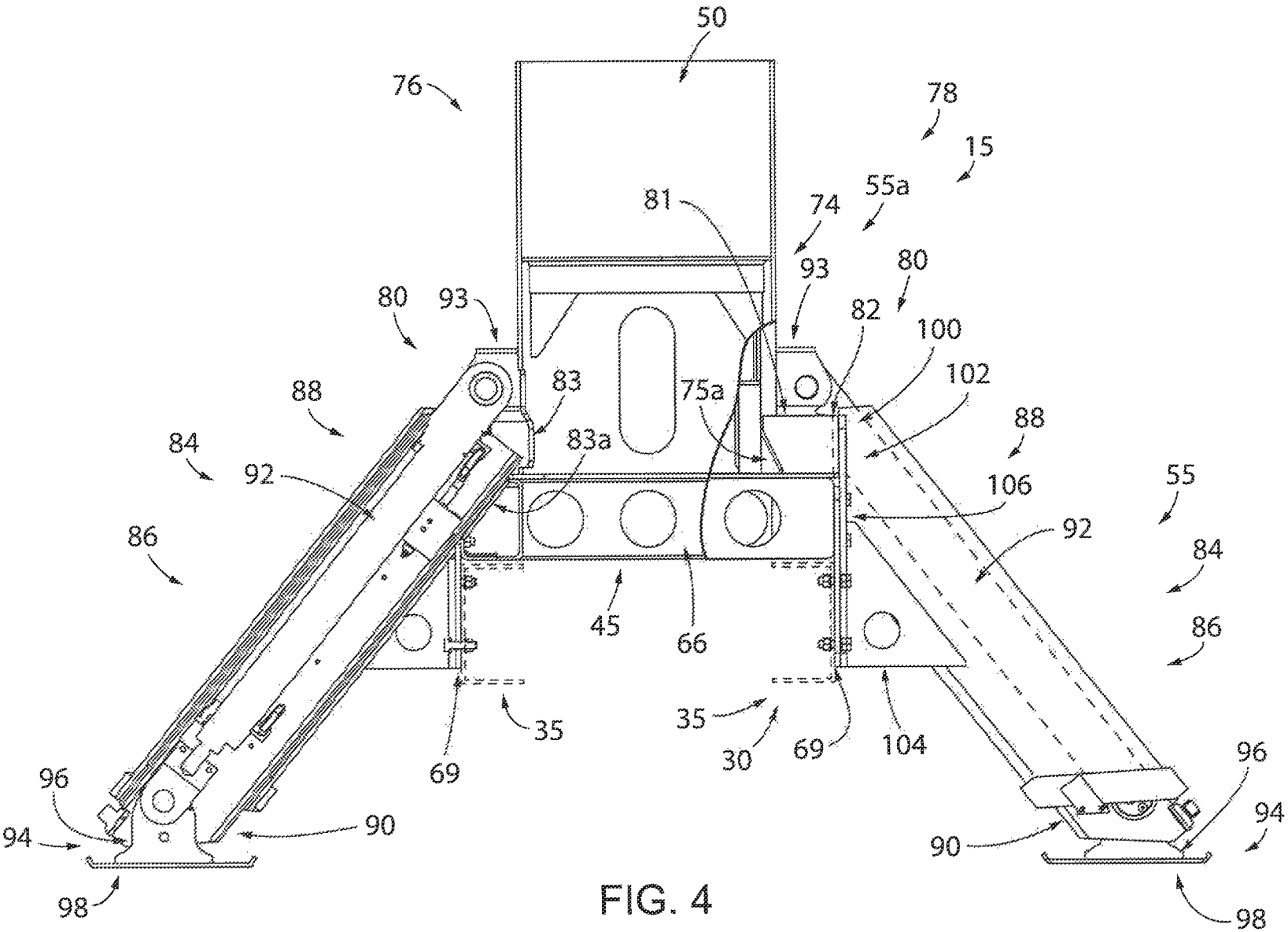
FIG. 4 is a partially cross-sectioned rear elevation view of portions of the turret support arrangement of FIG. 2.

Referring now to FIG. 4, as shown in the cross-sectioned portion toward the left of this view, channel 83 may extend downwardly into the plate of the torque box/outrigger mounts 69, giving the torque box/outrigger mounts 69 a U-shaped configuration (FIG. 3) with a generally rectangular cutout extending into their upper portions, and may also extend into torque rails 60, providing rectangular cutouts extending into their upper portions that align with the rectangular cutouts of the torque box/outrigger mounts 69. Channel 83 provides a passageway through various mounting components in which various components of the outrigger system 55 may be housed or translate. A ramped surface 83*a* that lies below various components of the outrigger system 55 may define a bottom wall of the channel 83, each extending at an angle upwardly from the cutouts of the torque box/outrigger mount(s) 69 and torque rails 60. Generally triangular side walls may extend upwardly from the ramped surface 83*a* to connect the ramped surface 83*a* to the outer and upper walls of the torque rails 60.

Still referring to FIG. 4, outrigger system 55 has a pair of outriggers 84 that are configured to selectively engage an underlying ground surface to support the back of vehicle 10 and provide anti-roll and other enhanced stability characteristics. Each outrigger 84 has a telescoping outrigger leg 86 that extends outwardly and angularly downward with respect to the vehicle chassis 30. Outrigger leg 86 has an upper leg segment 88 with a generally rectangular cross-sectional shape and the lower leg segment 90 that defines a movable leg segment of the telescoping outrigger leg 86 with a generally rectangular cross-sectional shape that is slightly smaller than that of upper leg segment 88, which allows the lower leg segment 90 to be telescopically received inside of the upper leg segment 88. Upper leg segment 88 is shown here connected to an upper portion of the outrigger support system 55*a*. A linear actuator such as a hydraulic cylinder 92 is arranged inside of each outrigger leg 86, with a first end fixed relative to the upper leg segment 88, shown here attached with a pin to a cylinder mount 93 that has a pair of lobes and an upper wall that are connected to the turret base 74 at a greater height on the turret base 74 than the turret support gussets 75*a*, which is shown in the non-sectioned portion toward the right in this view. A second end of hydraulic cylinder 92 is fixed relative to the lower leg segment 90, for example, secured with a pin to a bottom end of lower leg segment 90. Extending and retracting a piston of the hydraulic cylinder 92 correspondingly extends and retracts the lower leg segment 90 relative to upper leg segment 88 for selectively engaging the ground during stabilizing use or retracting to achieve a transport position. An outrigger foot 94 is arranged at an outer end of the lower leg segment 90. The outrigger foot 94 includes an outrigger foot mount 96 that is arranged at an outrigger foot outer portion 98, off-center toward the outside. The outrigger foot mount 96 defines a point of connection between the outrigger foot 94 relative to the perimeter shape of the outrigger foot 94 so that the outrigger foot 94 extends inwardly beyond a lower edge of the lower leg segment 90 farther than it extends outwardly past the lower edge of the lower leg segment 90.

Still referring to FIG. 4, as shown in the non-sectioned portion toward the right of this view, at upper ends of the outriggers 84, the outrigger legs 86 are connected to the vehicle 10 with a pair of outrigger mounts 100 of outrigger support system 55*a* that connect the outriggers 84 to multiple structural components of vehicle 10 at multiple locations to distribute forces between those components instead of concentrating forces in, for example, a single component. Each outrigger mount 100 is shown here with an outrigger mounting bracket 102 that may extend across and interconnect at least two of the vehicle chassis 30, the torque box 45, and the turret base 74. Each bracket 102 may include a pair of mounting bracket side flanges 104 (only one shown), shown here with a triangular perimeter shape, that extend from the opposite facing surfaces of an upper end of the outrigger upper leg segment 88, downwardly from the outrigger upper leg segment 88 toward the torque box 45 with the bottom edge of the mounting bracket side flanges 104 shown generally parallel to the ground. An outrigger mounting bracket plate 106, shown edge-wise in FIG. 4, extends between and interconnects the mounting bracket side flanges 104 to each other to provide a generally U-shaped configuration when viewed from above. Like the torque box/outrigger mounts 69 and aligned portion of the torque rails 60, the mounting bracket plate 106 has a generally rectangular cutout extending into its upper portion, aligned with those of the box/outrigger mounts 69 and torque rails 60, giving the mounting bracket plate 106 a U-shaped configuration that defines a portion of the channel 83. The outrigger mounting bracket plate 106 is shown here connected to each of the turret base 74, torque box 45, and chassis 30 through respective face-to-face connection engagements between the mounting bracket plate 106 with the turret tie-in plate(s) 82 and the torque box mount 68 at the torque rails 60 and the chassis frame rails 30.

Referring again to FIG. 2, the outrigger support system 55*a* interconnects the outrigger system 55 with multiple vertically stacked structural components of the vehicle 10, which gives the turret support arrangement 15 enough rigidity to maintain a suitably stable position of vehicle 10 during use of the articulated water tower 20. Furthermore, outrigger support system 55*a* provides multiple positions, layers, and surface area sizes of mounting interfaces of the interconnections of outrigger system 55 components with chassis 30, torque box 45, and turret 50 to distribute forces from the articulated water tower 20 into the vehicle chassis 30 and ground along multiple force transfer paths defined by the various mounting component interfaces. Toward a lower portion of the outrigger support system 55*a*, a first multi-layered interconnection is defined at an intermediate portion of the plate of the torque box/outrigger mount(s) 69, which is sandwiched between a lower portion of the outrigger mounting bracket plate 106 and the chassis frame rails 35. Outer segments of torque box/outrigger mount's 69 lower portion are shown extending outwardly in both directions beyond the outrigger mounting bracket plate's 106 lower portion. A second multi-layered interconnection is defined at an intermediate portion of the plate of the torque box/outrigger mount(s) 69, which is sandwiched between an intermediate portion of the outrigger mounting bracket plate 106 and the torque box's 45 torque rails 60. Outer segments of torque box/outrigger mount's 69 upper portion are shown extending outwardly in both directions beyond the outrigger mounting bracket plate's 106 intermediate portion. At an upper portion of the outrigger mounting bracket plate 106, a pair of aligned interconnections is defined on opposite sides of the outrigger leg's 86 upper end, between the respective outer segments of the outrigger mounting bracket plate's 106 upper portion and the pair of turret tie-in plates 82 of the upper outrigger mounts 81. Another interconnection between the outrigger system 55 and vehicle 10 is defined between the upper end of the hydraulic cylinder 92 and the cylinder mount 93, which is fixed to the turret base 74.

Many changes and modifications could be made to the invention without departing from the spirit thereof. The scope of these changes will become apparent from the appended claims.

What is claimed is:

1. A turret support arrangement for a fire apparatus vehicle that has a vehicle chassis with a pair of chassis frame rails, the turret support arrangement comprising:

a turret that is configured to support an articulated water tower;

a torque box that supports the turret; and an outrigger system that includes:

a pair of outriggers with each of the outriggers having:

a telescoping outrigger leg that selectively extends downward with respect to the vehicle chassis; and a pair of outrigger mounts that extends across and interconnects at least two of the vehicle chassis, the torque box, and the turret.

2. The turret support arrangement of claim 1, wherein:

the turret includes:

an upper end configured to support the articulated water tower;

a lower end that defines a turret base;

the torque box includes:

a pair of torque rails arranged parallel to and above the pair of chassis frame rails, wherein the torque rails support the turret base; and each of the outrigger mounting brackets extends across and interconnects the vehicle chassis frame rails, the torque rails, and the turret base.

3. The turret support arrangement of claim 2, wherein each outrigger mounting bracket extends across and interconnects each of the vehicle chassis, the torque box, and the turret base.

4. The turret support arrangement of claim 3, wherein each outrigger mounting bracket comprises:

a pair of mounting bracket side flanges that extend from opposite facing surfaces of an upper end of the respective telescoping outrigger leg; and a mounting bracket plate that interconnects the mounting bracket side flanges.

5. The turret support arrangement of claim 4, wherein the turret base defines left and right turret sides that correspond to left and right sides of the vehicle chassis and at each of the left and right turret sides, the turret base comprising:

a turret tie-in arrangement with a turret tie-in plate that is arranged generally upright and faces outwardly away from the respective left or right turret side, and wherein the turret tie-in plate engages the outrigger mounting bracket plate to connect the respective telescoping outrigger leg to the turret base.

6. The turret support arrangement of claim 5, wherein the torque box defines left and right torque box sides that correspond to left and right sides of the vehicle chassis and at each of the left and right torque box sides and at each of the left and right torque box sides, the torque box comprises:

a torque box mount with a torque box mount plate that is arranged generally upright and faces outwardly away from the respective left or right torque box side, and wherein the torque box mount plate engages the outrigger mounting bracket plate to connect the respective telescoping outrigger leg to the torque box.

7. The turret support arrangement of claim 6, wherein the respective turret tie-in plates and torque box mount plates are general vertically aligned with each other.

8. The turret support arrangement of claim 2, wherein the fire apparatus vehicle has a single rear axle supported by the vehicle chassis and the torque box comprises:

torque box mounts arranged at the torque rails for connecting the torque rails to the chassis frame rails, and wherein at each of the torque rails, at least a first one of the torque box mounts is arranged behind the rear axle and at least a second one of the torque box mounts is arranged in front of the rear axle.

9. The turret support arrangement of claim 8, wherein each of the torque rails includes at least two torque box mounts that are arranged in front of the rear axle.

10. The turret support arrangement of claim 2, wherein the outrigger system comprises an outrigger foot that defines inner and outer portions and includes an outrigger foot mount that is arranged at the outrigger foot outer portion, and wherein the outrigger foot mount defines a point of connection between the outrigger foot at the outrigger foot outer portion and a respective telescoping outrigger leg such that more of the outrigger foot extends inwardly beyond a lower edge of the telescoping outrigger leg than outwardly beyond the lower edge of the telescoping outrigger leg.

11. A fire apparatus vehicle, comprising:

a vehicle chassis with a pair of chassis frame rails;

a turret arranged above the vehicle chassis and including:

an upper end configured to support an articulated water tower;

a lower end that defines a turret base for supporting the turret and the articulated water tower;

a turret support arrangement, including:

a torque box arranged above the pair of chassis frame rails and below the turret and configured to transfer forces from the turret to the vehicle chassis;

an outrigger system, including:

a pair of outriggers with each of the outriggers including:

a telescoping outrigger leg that extends outwardly and angularly downward with respect to the vehicle chassis; and an outrigger support system, including:

pair of outrigger mounts connected to the pair of outriggers and with each of the outrigger mounts interconnecting the vehicle chassis and the torque box.

12. The fire apparatus vehicle of claim 11 wherein each outrigger mount includes a mounting bracket plate with upper and lower portions and with the respective telescoping outrigger leg connected to the mounting bracket plate upper portion and wherein the mounting bracket plate lower portion extends downwardly from the respective telescoping outrigger leg and is connected to the torque box.

13. The fire apparatus vehicle of claim 12 wherein:

the outrigger support system includes torque box mount plates that extend downwardly from the torque box; and at least lower portions of the torque box mount plates are sandwiched between the mounting bracket plate lower portions and the chassis frame rails.

14. The fire apparatus vehicle of claim 13 wherein a hydraulic cylinder is configured to actuate a movable leg segment of the telescoping outrigger leg and wherein an upper end of the hydraulic cylinder is connected to the turret.

15. The fire apparatus vehicle of claim 14 wherein the outrigger support system includes a cylinder mount that is connected to and extends outwardly from the turret base and wherein the upper end of the hydraulic cylinder is connected to the cylinder mount.

* * * * *